United States Patent [19]

Becker

[11] 3,982,284

[45] Sept. 28, 1976

[54] PORTABLE WASH STAND

[76] Inventor: Sylvester J. Becker, 633 Washington Ave., East Alton, Ill. 62024

[22] Filed: Aug. 27, 1974

[21] Appl. No.: 500,880

[52] U.S. Cl. ..... 4/145; 4/167; 4/185 R; 248/150

[51] Int. Cl.[2] ..... A47K 3/22; A61H 33/06

[58] Field of Search ..... 4/1, 167, 166, 168, 4/169, 170, 145, 152–157, 185 R, 185 S; 248/146, 156, 149, 413, 150

[56] References Cited

UNITED STATES PATENTS

| | | | |
|---|---|---|---|
| 2,021,145 | 11/1935 | Dyar | 4/145 |
| 3,018,490 | 1/1962 | Eichorst | 4/185 R |
| 3,828,373 | 8/1974 | Fraley | 4/167 |

*Primary Examiner*—Houston S. Bell, Jr.

[57] ABSTRACT

Portable wash stand for use primarily outdoors comprising base means, an elongated vertical support member mounted on the base means, basin and soap dish means mounted on the support member, and faucet means mounted on the upper portion of the support member.

15 Claims, 3 Drawing Figures

29
2
32
30
31
32
28

20
24
22
23
19
6
17
18
5
14
16
2
15
4
25
13
7
3
26
13
8
11
8
8
11
2
10
13
11
12

27

PORTABLE WASH STAND

BACKGROUND OF THE INVENTION

A need exists for a simple reliable and economical portable wash stand for use in conjunction with sporting trips, comprising, mobile homes and the like. Most devices available are too complicated, difficult to set up and take down or do not provide the facilities desired by the user.

SUMMARY OF THE INVENTION

In the present invention a device is contemplated which in its preferred embodiment is intended for the suggested uses and comprises primarily a vertical support member, collapsible base means mounted on the lower portion of the support member, a basin hoop mounted on the upper portion of the support member and disposed essentially horizontally and either collapsibly or removably attached to the support member, and a fluid system attached to the upper portion of the support member. The fluid system comprises a vertical pipe member, provided with faucet means, attached to the upper portion of the support member, and horizontal pipe means attached fluidly to the upper portion of the vertical pipe member and provided with shower means.

It is therefore a primary object of the invention to provide a portable wash stand which is simple, reliable and economically manufactured.

A further object is to make such a device which has minimal set-up and take-down times.

With the above primary and other incidental objects in view which will more fully appear in the specification of the invention which is provided herein, the invention intended to be protected by Letters Patent consists of the features of construction of the parts and combinations thereof, and the mode of operation hereinafter described or illustrated in the accompanying drawings, or their equivalents.

BRIEF DESCRIPTION OF THE DRAWINGS

Referring to the drawings, wherein is illustrated a preferred but not the only form of embodiment of the invention.

DETAILED DESCRIPTION OF THE INVENTION

Figures 1, 2, 3:
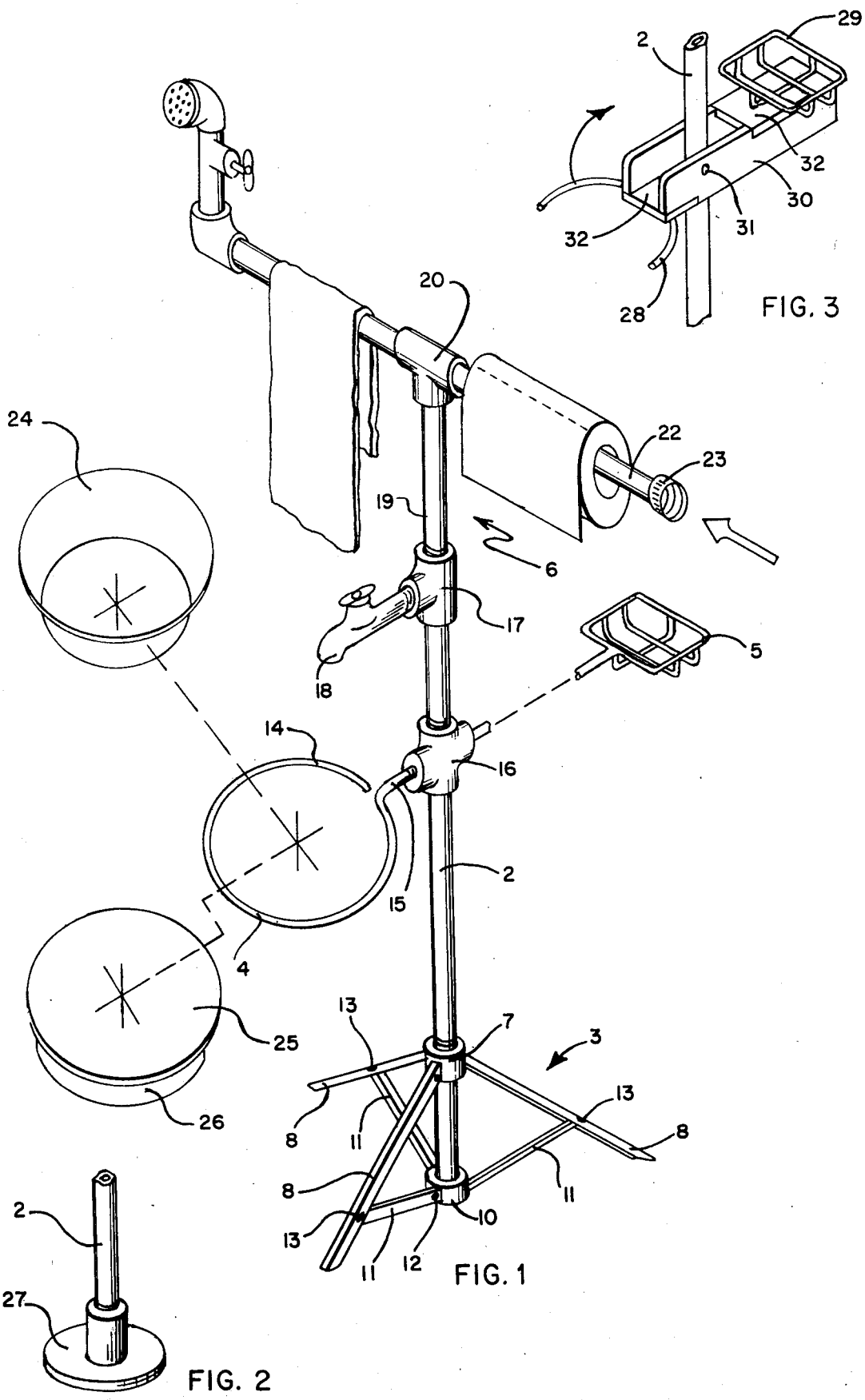
FIG. 1 is a perspective view of a portable wash stand constructed in accordance with and embodying the present invention.
FIG. 2 is an alternate base means for use with the device shown in FIG. 1.
FIG. 3 is a partial perspective of an alternate basin hoop and soap dish configuration with an alternate mounting to the device shown in FIG. 1.

Referring now to the drawings and in particular to FIG. 1, the portable wash stand, 1, is shown in perspective to comprise primarily of the vertical support member, 2, with base means, 3, attached to the lower end thereof, basin means, 4, and soap dish means, 5, attached to the upper portion thereof and the fluid system, 6, attached to the upper portion of support member, 2.

Base means, 3, comprises collar, 7, adapted to move longitudinally of member, 2, to which are attached pivotally, legs, 8, at pivots, 9, cap, 10, which is secured to the bottom of member, 2, and struts, 11, which are pivotally attached to cap, 10, at pivots, 12, and to legs, 8, at pivots, 13.

Basin means, 4, in one configuration has simply a hoop portion, 14, attached by conventional means such as threaded portion, 15, to union, 16, on member, 2, and into which is seated basin, 24. Soap dish, 5, may also be attached conventionally by threaded portion to union, 16. The fluid system, 6, is attached to member, 2, by "T" joint, 17, a hollow joint, which has a conventional faucet, 18, attached thereto. Pipe means, 19, attached to joint, 17, supports joint, 20, to which is attached shower means, 21, and water inlet pipe, 22, to which is attached hose coupler, 23.

In other configurations, cutting board, 25, may be used in hoop, 14, in place of basin, 24. Board, 25, is provided with shoulder, 26, which prevents it from moving in hoop, 14. An alternate base means, 27, is shown in FIG. 2.

FIG. 3 shows an alternate structure for basin means, 8, and soap dish, 29, and the structural method of attaching them to member, 2. As shown in FIG. 3, basin means, 28, may be attached to bracket, 30, by welding or other conventional technique and the same is true for soap dish, 29. However, bracket, 30, is pivotally attached to member, 2, by pivot, 31. As shown, the basin and soap dish portion may be collapsed by moving basin means upward and in contact with member, 2. Bracket portion, 32, holds basin means approximately level.

While I have illustrated and described the preferred embodiments of my invention, it is to be understood that changes and modifications in the form, construction, arrangement and combination of the parts and steps of the portable wash stand and methods of making and using the same may be substituted for those herein shown and described without departing from the nature and principle of my invention.

Having thus described my invention, what I claim as new and desire to secure by U.S. Letters Patent is:

1. A portable wash stand comprising,
base means, said base means comprising a collapsible tripod,
an elongated vertical support member mounted on said base means,
basin and soap dish means pivotally mounted to the vertical support member,
fluid dispensing means operably attached to said vertical support member.

2. A portable wash stand comprising,
base means,
an elongated vertical support member mounted on said base means,
basin and soap dish means operably mounted to said vertical support member,
a vertically extending elongated tubular member operably mounted to the upper end of said vertical support member, said tubular member closed at the bottom end thereof provided with a fluid inlet end and an outlet port,
tap means operably mounted on said tubular member and communicating with said outlet port,
hose connection means operably coupled to the fluid inlet end of said tubular member.

3. A portable wash stand as described in claim 2 wherein said basin and soap dish means are pivotally mounted to said vertical support member.

4. A portable wash stand as described in claim 3 wherein said basin and soap dish means comprises a channel member, a ring member operably mounted on one end of said channel member and a soap dish mounted on the opposite end of said channel member.

5. A portable wash stand as described in claim 3 in combination with a tubular towel rack member operably connected to the upper end of said tubular member and shower means operably coupled to said tubular towel means.

6. A portable wash stand as described in claim 3 wherein said basin and soap dish means are pivotally mounted to said vertical support member, said pivoting being about an axis essentially transverse to the vertical support member and in a plane containing the vertical support member.

7. A portable wash stand as described in claim 6 wherein said basin and soap dish means comprises a channel member, a ring member operably mounted on one end of said channel member and a soap dish mounted on the opposite end of said channel member.

8. A portable wash stand as described in claim 6 in combination with a tubular towel rack member operably connected to the upper end of said tubular member and shower means operably coupled to said tubular towel means.

9. A portable wash stand as described in claim 7 wherein said channel member, ring member and soap dish form a pivotally mounted assembly which collapses to said vertical support member when said ring is raised.

10. A portable wash stand as described in claim 9 wherein said base means comprises a collapsible tripod.

11. A portable wash stand as described in claim 9 wherein said base means comprises ring means movably mounted on said vertical support member, a plurality of legs pivotally mounted at one end to the ring and support members pivotally mounted from each leg to the lower end of the vertical support member.

12. A portable wash stand as described in claim 11 wherein said plurality of legs equals three.

13. A portable wash stand as described in claim 10 wherein said channel member comprises a pair of elongated essentially rectangular plates disposed essentially parallel to each other, a bottom plate operably mounted between said rectangular plates along the lower edge thereof and proximate one end a top plate operably mounted between said rectangular plates along the top edge thereof and proximate the opposite end thereof, said top plate and bottom plate being spaced apart in a longitudinal direction a distance proximate the transverse dimension of the vertical support member.

14. A portable wash stand as described in claim 11 wherein said channel member comprises a pair of elongated essentially rectangular plates disposed essentially parallel to each other, a bottom plate operably mounted between said rectangular plates along the lower edge thereof and proximate one end a top plate operably mounted between said rectangular plates along the top edge thereof and proximate the opposite end thereof, said top plate and bottom plate being spaced apart in a longitudinal direction a distance proximate the transverse dimension of the vertical support member.

15. A portable wash stand as described in claim 12 wherein said channel member comprises a pair of elongated essentially rectangular plates disposed essentially parallel to each other, a bottom plate operably mounted between said rectangular plates along the lower edge thereof and proximate one end a top plate operably mounted between said rectangular plates along the top edge thereof and proximate the opposite end thereof, said top plate and bottom plate being spaced apart in a longitudinal direction a distance proximate the transverse dimension of the vertical support member.

* * * * *